US011278071B2

(12) United States Patent
Darmour et al.

(10) Patent No.: US 11,278,071 B2
(45) **Date of Patent: *Mar. 22, 2022**

(54) GARMENT HAVING SELECTED STRETCH ZONES

(71) Applicant: NIKE, Inc., Beaverton, OR (US)

(72) Inventors: Robert O. Darmour, Portland, OR (US); Charles R. Darmour, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 37 days.

This patent is subject to a terminal disclaimer.

(21) Appl. No.: 16/787,461

(22) Filed: Feb. 11, 2020

(65) Prior Publication Data

US 2020/0170315 A1 Jun. 4, 2020

Related U.S. Application Data

(63) Continuation of application No. 15/677,095, filed on Aug. 15, 2017, now Pat. No. 10,609,968.
(Continued)

(51) Int. Cl.
*A41D 3/00* (2006.01)
*A41D 27/10* (2006.01)
(Continued)

(52) U.S. Cl.
CPC ..... *A41D 31/04* (2019.02); *A41D 1/04* (2013.01); *A41D 3/005* (2013.01); *A41D 27/10* (2013.01);
(Continued)

(58) Field of Classification Search
CPC ..... A41D 31/02; A41D 27/10; A41D 27/08; A41D 1/04; A41D 3/005; A41D 2200/20;
(Continued)

(56) References Cited

U.S. PATENT DOCUMENTS 3,063,058 A 11/1962 Vollet
3,585,645 A 6/1971 Sugiyamakk
(Continued)

FOREIGN PATENT DOCUMENTS

AU 1350388 A 9/1988
AU 2040295 A 5/1996
(Continued)

OTHER PUBLICATIONS

International Search Report and Written Opinion received for PCT Patent Application No. PCT/US2017/047074 , dated Nov. 16, 2017. 14 pages.
(Continued)

*Primary Examiner* — Amy Vanatta
(74) *Attorney, Agent, or Firm* — Shook Hardy & Bacon, LLP

(57) ABSTRACT

A garment portion made primarily from a material with low-stretch characteristics, having defined stretch zones with greater flexibility is provided herein. The stretch zones have slits through the garment portion. An interior layer having higher stretch characteristics than the garment body portion is affixed to the internal surface of the garment body portion in the area of the stretch zone. The result is a garment portion that is primarily constructed with a low-stretch material that has stretch zones allowing greater flexibility.

16 Claims, 5 Drawing Sheets

Related U.S. Application Data

(60) Provisional application No. 62/376,086, filed on Aug. 17, 2016.

(51) Int. Cl.
*A41D 1/04* (2006.01)
*A41D 31/04* (2019.01)

(52) U.S. Cl.
CPC ..... *A41D 2200/20* (2013.01); *A41D 2400/38* (2013.01); *A41D 2500/10* (2013.01); *A41D 2500/20* (2013.01)

(58) Field of Classification Search
CPC ..... A41D 2500/20; A41D 2400/38; A41D 2500/10; A41D 1/02; A41D 1/18; A41D 3/02; A41D 3/00; A41D 13/0015; A41D 13/02; A41D 27/02; A41D 2300/22; A41D 31/04; A41D 1/08; A41D 1/06; A41B 1/08; A41B 2300/22
See application file for complete search history.

(56) References Cited

U.S. PATENT DOCUMENTS

| | | | | |
|---|---|---|---|---|
| 4,513,451 | A | 4/1985 | Brown | |
| 4,608,716 | A | 9/1986 | Brumfield | |
| 5,052,053 | A | 10/1991 | Peart et al. | |
| 5,175,888 | A | 1/1993 | Clark | |
| 5,415,715 | A | 5/1995 | Delage et al. | |
| 5,727,256 | A | 3/1998 | Rudman | |
| 5,804,021 | A | 9/1998 | Abuto et al. | |
| 8,002,724 | B2 | 8/2011 | Hu et al. | |
| 8,043,244 | B2 | 10/2011 | Einarsson et al. | |
| 8,084,117 | B2 | 12/2011 | Lalvani | |
| 8,231,756 | B2 | 7/2012 | Kim | |
| 8,347,415 | B2 | 1/2013 | Mazzarolo | |
| RE44,851 | E | 4/2014 | Taylor | |
| 8,726,414 | B2 | 5/2014 | Baron et al. | |
| 8,852,392 | B2 | 10/2014 | Homoelle et al. | |
| 8,910,313 | B2 | 12/2014 | Gordon et al. | |
| 2004/0148679 | A1 | 8/2004 | Garneau | |
| 2005/0034204 | A1 | 2/2005 | Kassai et al. | |
| 2005/0204449 | A1 | 9/2005 | Baron et al. | |
| 2005/0282454 | A1 | 12/2005 | Meschter et al. | |
| 2006/0143767 | A1 | 7/2006 | Yang et al. | |
| 2008/0201819 | A1* | 8/2008 | Wheater | A41D 31/00 2/78.3 |
| 2009/0172859 | A1 | 7/2009 | Clement | |
| 2010/0011479 | A1 | 1/2010 | Onoda et al. | |
| 2011/0209275 | A1 | 9/2011 | Berns et al. | |
| 2012/0222189 | A1 | 9/2012 | Sokolowski et al. | |
| 2013/0042377 | A1 | 2/2013 | Moore et al. | |
| 2014/0020149 | A1* | 1/2014 | Yamada | A41B 9/06 2/69 |
| 2014/0208492 | A1 | 7/2014 | Foley et al. | |
| 2016/0338415 | A1 | 11/2016 | Aihara | |
| 2018/0049494 | A1 | 2/2018 | Darmour et al. | |

FOREIGN PATENT DOCUMENTS

| | | | |
|---|---|---|---|
| CH | 286837 | A | 11/1952 |
| CN | 102613730 | A | 8/2012 |
| CN | 102666085 | A | 9/2012 |
| CN | 103519427 | A | 1/2014 |
| WO | 2008010140 | A2 | 1/2008 |
| WO | 2013028370 | A1 | 2/2013 |

OTHER PUBLICATIONS

International Preliminary Report on Patentability received for PCT Patent Application No. PCT/US2017/047074, dated Feb. 28, 2019. 8 pages.

Non-Final Office Action received for U.S. Appl. No. 15/677,095, dated May 29, 2019. 14 pages.

Final Office Action received for U.S. Appl. No. 15/677,095, dated Oct. 21, 2019. 11 pages.

Notice of Allowance and Fees Due received for U.S Patent Application No. .5/677,095, dated Dec. 13, 2019. 5 pages.

"14*11cm Sleeve stick wholesale Knee post flocking material buiter oval elbow patch cut at random," Aliexpress, aliexpress.com, Seller: koryo gao's store, 2015. http://www.aliexpress.com/item/14-11cm-Sleeve-stick-wholesale-Knee-post-flocking-material-buiter-oval-elbow-patch-cut-at-random/2028661679.html. 4 pages.

"Application Instructions," 1 Ferret's Trrasures—Appliques & Patches, 1ferretstreasures.com, 2015. http://1ferretstreasures.com/application-instructions/. 5 pages.

Jessyratfink, "How to patch stretchy jeans," Instructables, instructables.com, 2014. http://www.instructables.com/id/how-to-patch-stretchy-jeans/. 4 pages.

Intention to Grant received for European Patent Application No. 17758357.2, dated Mar. 11, 2021, 7 pages.

* cited by examiner

GARMENT HAVING SELECTED STRETCH ZONES

CROSS-REFERENCE TO RELATED APPLICATIONS

This application is a continuation of U.S. patent application Ser. No. 15/677,095, filed Aug. 15, 2017, which application claims the benefit of priority to U.S. Provisional Application No. 62/376,086, filed Aug. 17, 2016, each of which is herein incorporated by reference in its entirety.

FIELD

The present disclosure relates to a garment, or a portion of a garment, having selected stretch zones, offering added flexibility in the area of the stretch zone.

BACKGROUND

Traditional garments are often made from a material that has low stretch characteristics. As an example, many garments are made from a low-stretch-woven material. One disadvantage of these materials is their general lack of flexibility, resulting in either restricted movement, or garments that are uncomfortable in active settings. One solution has been to construct garments of materials having high-stretch characteristics. However, the look, feel, and functionality of these garments may not be as desirable to the consumer.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects herein are directed to a garment, or a portion of a garment, made primarily from a material with low-stretch characteristics. The garment body has an external surface and an internal surface. In defined stretch zones, the garment body has a plurality of slits extending through the body, from the external surface to the internal surface. An interior layer having higher stretch characteristics than the garment body is affixed to the internal surface in the area of the stretch zone. The result is a garment, or a portion of a garment, that is primarily constructed with a low-stretch material that has stretch zones allowing greater flexibility. This makes the garment useful for more active activities that benefit from greater flexibility in the garment. The garment described herein may further comprise stretch zones in a variety of locations on the garment, where the locations are selected based on the intended end uses. The stretch zones may be formed with slits of varying length, and width and spacing there-between.

Aspects herein further relate to a method of manufacturing a garment, or a portion of a garment, having defined stretch zones. The method may comprise providing a garment body portion made from a material having low stretch characteristics. In an exemplary aspect, this material is a low stretch-woven material. One or more stretch zones are defined on the garment body portion, including determining where on the garment body portion the one or more stretch zones should be located. Continuing, for each of the defined stretch zones, slits are formed in the garment body portion. The slits are oriented to allow expansion of the slits as tensioning forces are applied to the garment in the area of the stretch zones. For each of the one or more stretch zones, the method comprises affixing an interior layer to the internal surface of the garment body portion in the area of the stretch zone, such that the interior layer covers the slits in the stretch zone. The interior layer is made from a material having higher stretch properties than the garment body portion. In one exemplary aspect, the internal surface of the garment body portion is coated with a heat activated adhesive in the area of the stretch zone. With the interior layer in place against the surface of the stretch zone, (after the slits are cut), heat is applied to thereby affix the interior layer to the garment body portion. The slits combined with the stretch interior layer provide added flexibility to the garment in the defined stretch zones.

BRIEF DESCRIPTION OF THE DRAWINGS

Examples of the present invention are described in detail below with reference to the attached drawing figures, wherein.

DETAILED DESCRIPTION

Figure 1:
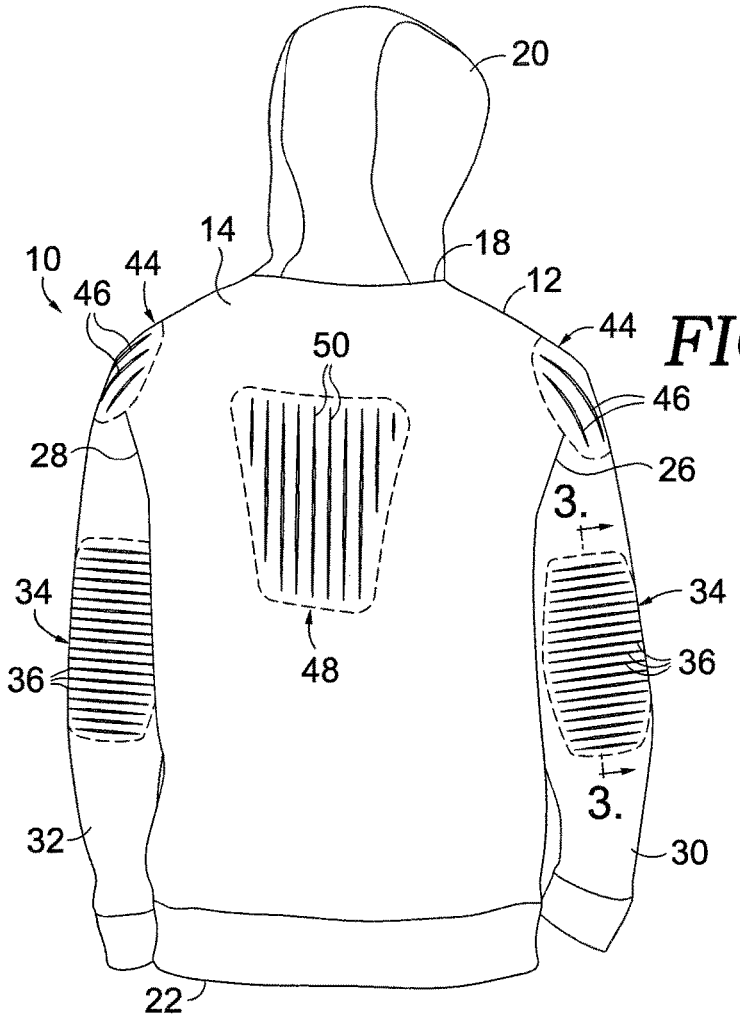
FIG. 1 illustrates a back view of an exemplary garment with stretch zones at the elbows, shoulders, and mid-back area, in accordance with an aspect herein.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein relate to a garment, or a portion of a garment, made primarily from a material with low-stretch characteristics. The garment body portion has an external surface and an internal surface. In defined stretch zones, the garment body portion has a plurality of slits extending through the body, from the external surface to the internal surface. An interior layer having higher stretch characteristics than the garment body portion is affixed to the internal surface in the area of the stretch zone. The stretch zones may be formed with slits of varying length, and width and spacing there-between. The result is a garment, or a portion of a garment, that is primarily constructed with a low-stretch material that has stretch zones allowing greater flexibility. This makes the garment useful for more active activities that benefit from greater flexibility in the garment. The garment described herein may further comprise stretch zones in a variety of locations on the garment, where the locations are selected based on the intended end uses. For instance, the stretch zones may be located on the garment in areas subject to high degrees of tensioning forces. By way of illustrative example, stretch zones may be located over the elbow area, shoulder area, and upper back area of a garment for an upper torso of a wearer. In another example, the stretch zones may be located on a hood portion of garment, and/or at the knee area of a garment for a lower torso of a wearer.

Aspects herein further relate to a method of manufacturing a garment having defined stretch zones. The method may comprise providing a garment body, or a portion of a garment body, made from a material having low stretch characteristics. In an exemplary aspect, this material is a low stretch-woven material. One or more stretch zones are defined on the garment body portion, including determining where on the garment body portion the one or more stretch zones should be located. In general, stretch zones are defined on areas of the garment body, or garment body portions, that are subject to higher-than-normal tensioning forces. Continuing, for each of the defined stretch zones, slits are formed in the garment body portion. The slits are oriented to allow expansion of the slits as the tensioning forces are applied to the garment body portion in the area of the stretch zones. For each of the one or more stretch zones, the method comprises affixing an interior layer to the internal surface of the garment body portion in the area of the stretch zone, such that the interior layer covers the slits in the stretch zone. The interior layer is made from a material having higher stretch properties than the garment body portion. In one exemplary aspect, the internal surface of the garment body portion is coated with a heat activated adhesive in the area of the stretch zone. With the interior layer in place against the surface of the stretch zone, (after the slits are cut), heat is applied to thereby affix the interior layer to the garment body portion. Other ways of affixing the interior layer to the garment body portion are contemplated herein such as stitching, ultrasonic welding, laser welding, and the like. The slits combined with the stretch interior layer provide added flexibility to the garment in the defined stretch zones.

Continuing, the term "affixing" as used throughout this disclosure is meant to encompass a variety of technologies used to affix fabric panels together. Such affixing technologies may comprise stitching, zippers, buttons, snaps and other types of fasteners, hook-and-loop fasteners, bonding via heat, ultrasound, laser, adhesives, chemical processes, and other affixing technologies known in the art. The term "external surface" is defined as the surface of a garment that faces the exterior environment (away from the wearer) when the garment is in an as-worn condition. The term "internal surface" is defined as the surface of a garment that faces the wearer when the garment is in an as-worn condition.

Turning now to the figures, FIG. 1 depicts a rear view of a garment 10. Garment 10 is shown as a hoodie sweatshirt as an exemplary aspect. Other garments, such as jackets or coats, could, of course, be made using the same principles discussed below and the disclosure is in no way limited to the garment configurations depicted in the figures. Garment 10 has a garment body 12 made from a material having low-stretch characteristics. As an example, and without limitation, garment body 12 can be made from a woven material having low-stretch properties. Garments constructed of woven materials, as opposed to knitted materials, may be more suitable for cold-weather activities due to the tighter weave that can generally be achieved with woven materials. The tighter weave, in turn, may cause the garment to exhibit increased warmth and durability characteristics as compared to some knitted garments.

Figure 2:
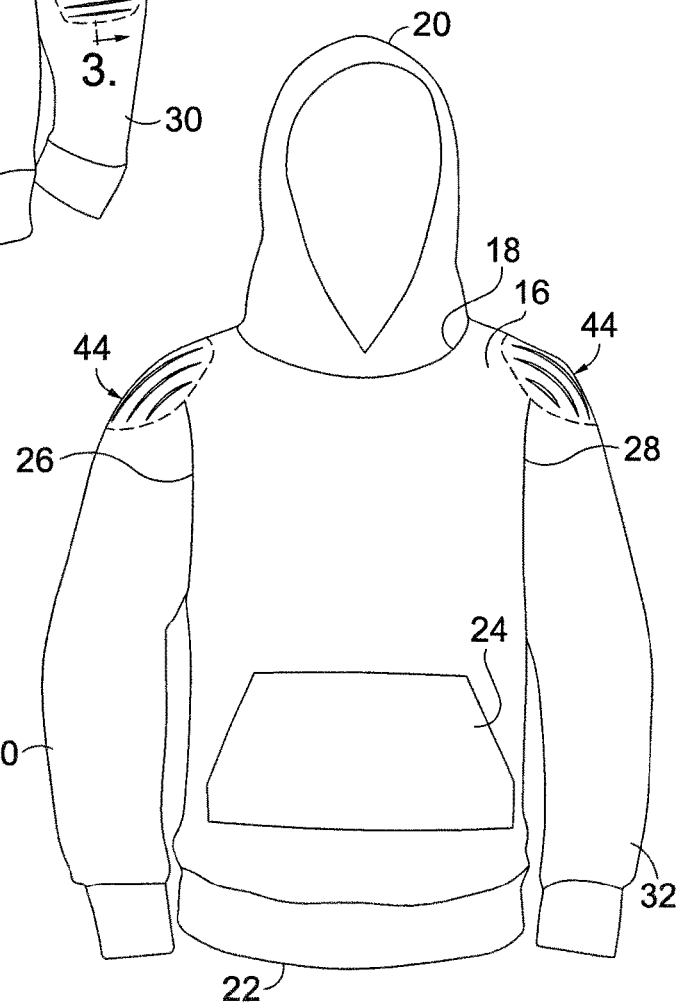
FIG. 2 illustrates a front view of the exemplary garment of FIG. 1, in accordance with an aspect herein.

In this exemplary aspect, garment 10 is formed from a back panel 14 affixed to a front panel 16 (FIG. 2). Front panel 16 is shown as a single panel, forming a pull-over configuration. Front panel 16 may also be divided into two panels which are adapted to be joined, such as in a button-up or front-zip configuration. The patterns for back panel 14 and front panel 16 are shaped such that a neckline opening 18 is formed when back panel 14 and front panel 16 are affixed to one another. A hood 20 may optionally be affixed to garment 10 around the neckline opening 18. Back panel 14 and front panel 16 further form a waist opening 22 opposite neckline opening 18. As seen in FIG. 2, a pocket 24 may optionally be affixed to front panel 16 generally adjacent waist opening 22. Back panel 14 and front panel 16 further form a right sleeve opening 26 and a left sleeve opening 28. A corresponding right sleeve 30 is affixed to right sleeve opening 26, and a left sleeve 32 is affixed to left sleeve opening 28.

Figure 3:
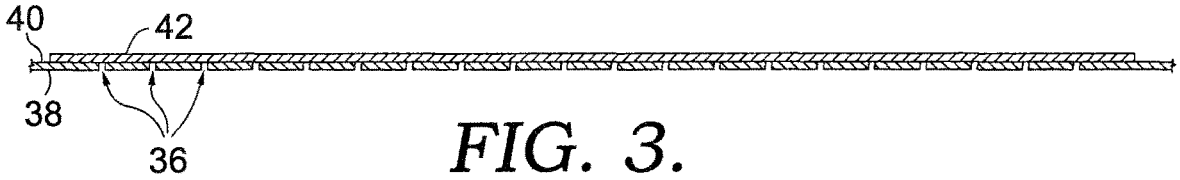
FIG. 3 is a partial cross-section, taken along link 3-3 of FIG. 1, in accordance with an aspect herein.

As shown in FIG. 1, right sleeve 30 and left sleeve 32 each have a stretch zone 34 located in the elbow area when garment 10 is in an as-worn condition. Sleeves 30 and 32 form a portion of the garment 10. As best seen in FIG. 3, the stretch zone has a series of slits 36 that extend from an external surface 38 to an internal surface 40, such that slits 36 extend through the material forming right sleeve 30 and left sleeve 32 in the stretch zone 34. Turning back to FIG. 1, it can be seen that slits 36 are orientated orthogonally to the plane in which the right sleeve 30 and left sleeve 32 typically bend when the garment 10 is worn (e.g., when the wearer bends his or her elbow).

Turning back to FIG. 3, an interior layer 42 is affixed to the internal surface 40 in the area of stretch zone 34. Interior layer 42 is made from a material having higher-stretch characteristics than garment body 12 such as a stretch-woven material, or a stretch-knit material. In exemplary aspects, the interior layer 42 may comprise a continuous panel without slits. By affixing a continuous panel in the area underlying the slits 36, precipitation is prevented from entering the garment 10 via the slits 36 and body heat is prevented from escaping the garment 10 via the slits 36. In one exemplary aspect, a heat-activated adhesive layer is applied to one of internal surface 40, or to the surface of interior layer 42 facing internal surface 40. The slits 36 are cut through from the external surface 38 to the internal surface 40. With interior layer 42 in position in the stretch zone, heat is applied to activate the adhesive and affix the interior layer 42 to internal surface 40. Other ways of affixing the interior layer 42 to the internal surface 40 are contemplated herein.

Figure 4:
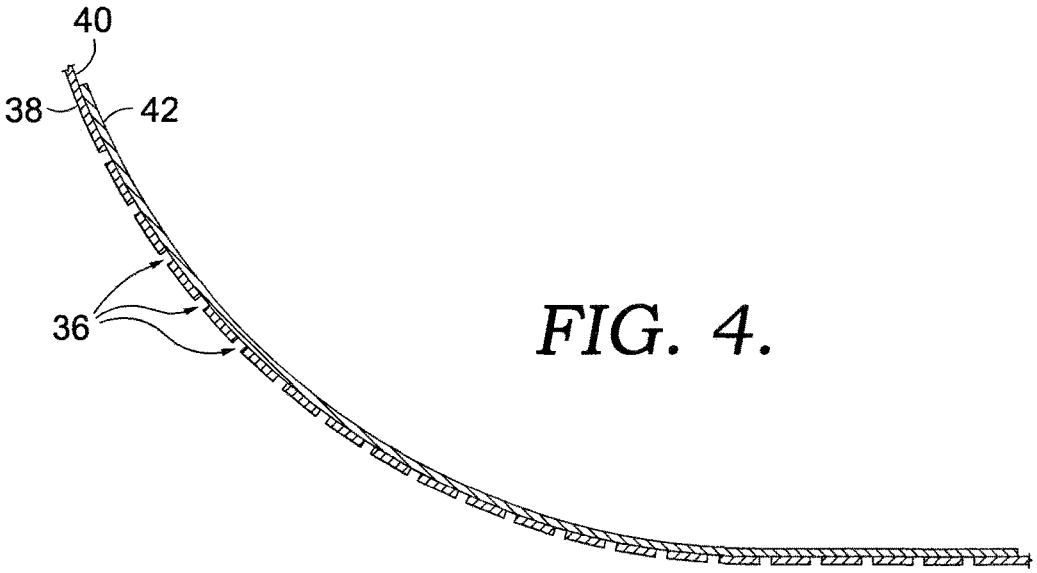
FIG. 4 is a view similar to FIG. 3, but showing the garment section in a bent or flexed condition, in accordance with an aspect herein.

The slits 36, oriented orthogonally to the plane of a typical bending motion, and the higher stretch interior layer 42 allow the right sleeve 30 and left sleeve 32 additional flexibility as compared to garments, or portions of garments, without a stretch zone 34 as described above. FIG. 4 illustrates the stretch zone 34 of FIG. 3 in a bent condition. Note that the spacing between slits 36 increases as the stretch zone 34 bends, allowed by the slits 36 and the higher stretch characteristics of interior layer 42. In an exemplary aspect, interior layer 42 may be made from a material having a contrasting color, or complimenting color, as compared to garment body 12. As the spacing between slits 36 increases with a flexing of the stretch zone 34, the interior layer is more exposed to view, and the contrasting or complimenting color may be a desirable design aspect.

Figure 3A:
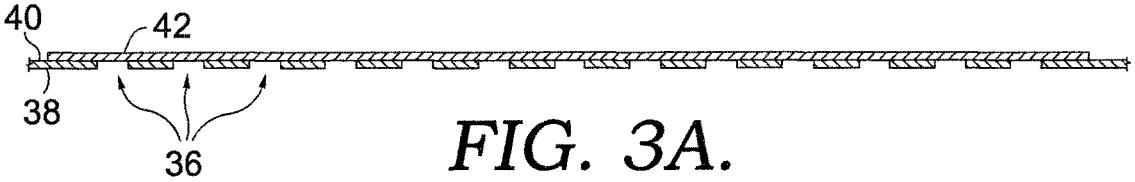
FIG. 3A is a partial cross-section, similar to FIG. 3, but showing increased spacing between slits, in accordance with an aspect herein.
Figure 3B:
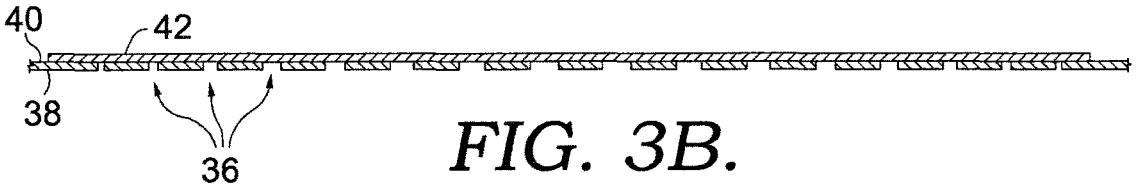
FIG. 3B is a partial cross-section, similar to FIG. 3, but showing variable spacing between slits, in accordance with an aspect herein.

FIG. 3 illustrates a stretch zone 34 with relatively narrow slits 36. In another exemplary aspect shown in FIG. 3A, a stretch zone 34 is shown with wider slits 36 (as compared to FIG. 3). Wider slits may provide increased stretch properties, as compared to narrower slits. In another exemplary aspect, a stretch zone 34 is shown with slits 36 having a gradation in width in FIG. 3B. In this exemplary aspect, slits 36 increase in width from one edge of stretch zone 34 to the center of stretch zone 34, and then decrease in width from the center of stretch zone 34 to the other edge of stretch zone 34. Thus, wider slits 36 may be located in the area of the stretch zone 34 subject to the highest degree of tensioning forces, thereby providing increased stretch properties to this area.

Returning to FIGS. 1 and 2, the garment 10 may also or alternatively have stretch zones 44 in the shoulder area of the garment 10. Stretch zones 44 may span portions of front panel 16, back panel 14, right sleeve 30, and left sleeve 32. Alternatively, the patterns of front panel 16, back panel 14, right sleeve 30, and left sleeve 32 may be shaped such that an individual stretch zone 44 is formed in a single panel, or garment portion. In an exemplary aspect, one stretch zone 44 may be formed in right sleeve 30 and one stretch zone 44 may be formed in left sleeve 32. In this exemplary aspect, right sleeve 30 and left sleeve 32 could be extended further into the shoulder area, with right sleeve opening 26 and left sleeve opening 28 located closer to neckline opening 18.

Similar to stretch zones 34, stretch zones 44 have a series of slits 46 formed therein, and the internal surface of garment body 12 in the area of stretch zones 44 has an interior layer affixed thereto in a similar fashion as that described above with respect to interior layer 42 shown in FIGS. 3 and 4. As best seen in FIG. 2, stretch zones 44 may have a somewhat oval shape, and slits 46 may be of varying length across the stretch zone 44. In an exemplary aspect, slits 46 may have a longer length in the middle of stretch zone 44 and a shorter length near the outer edges of stretch zone 44. This configuration may impart a greater stretch characteristic to the middle of the stretch zone 44 (i.e., the area subject to greater tensioning forces). As shown, slits 46 are oriented orthogonally to an anticipated typical bending of garment 10 in the area of stretch zone 44 (e.g., a wearer reaching his or her arms forward or across their body). Similar to stretch zones 34, slits 46 in stretch zones 44 may have varying widths and/or variable spacing between slits 46. Stretch zones 44, having slits 46 and an interior layer having greater stretch properties than garment body 12, allow greater flexibility in the shoulder area of garment 10.

Returning to FIGS. 1 and 2, the garment 10 may also or alternatively have a stretch zone 48 in the mid-back area of the garment 10 on back panel 14. Similarly to stretch zones 34 and 44, stretch zone 48 has a series of slits 50 formed therein, and the internal surface of back panel 14 in the area of stretch zone 48 has an interior layer affixed thereto in a similar fashion as that described above with respect to interior layer 42 shown in FIGS. 3 and 4. As best seen in FIG. 1, stretch zone 48 may have a somewhat trapezoidal shape, and slits 50 may be of varying length across the stretch zone 48. In an exemplary aspect, slits 50 may have a longer length in the middle of stretch zone 48 and a shorter length near the outer edges of stretch zone 48. As shown, slits 46 are oriented orthogonally to an anticipated typical movement of garment 10, or the portion of garment 10, in the area of stretch zone 48 when the garment 10 is worn and used (e.g., the wearer reaching his or her arms forward). Similar to stretch zones 34 and 44, slits 50 in stretch zone 48 may have varying widths and/or variable spacing between the slits 50. Stretch zone 48, having slits 50 and an interior layer having greater stretch properties than garment body 12, allows greater flexibility across the back area of garment 10.

Figure 5:
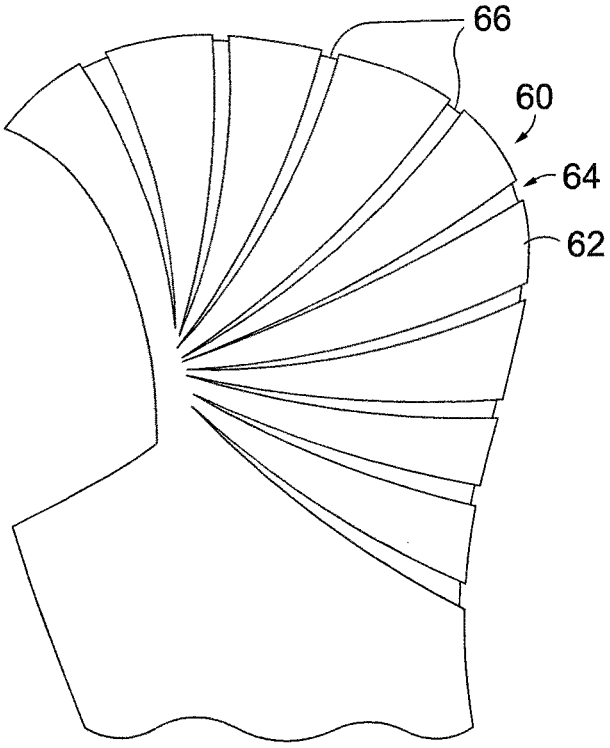
FIG. 5 illustrates a side view of an exemplary hood portion in accordance with an aspect herein.

FIG. 5 shows an alternative exemplary aspect of a hood 60 for use on garment 10. Like garment body 12, hood 60 has a hood body 62 that is made from a material having low-stretch characteristics. The hood body 62 has a series of slits 64 cut through the hood body 62. In an exemplary aspect, the slits 64 may be cut through hood body 62 with a laser, a mechanical cutter, a water-jet cutter, and the like. The hood 60 also has a hood interior layer 66, affixed to the internal surface of hood body 62, that is made from materials similar to, or the same as, the interior layer 42 described above. For instance, hood interior layer 66 is made from a material having higher stretch properties than hood body 62. The hood interior layer 66 may be affixed to the internal surface of the hood body 62 via, for example, a heat-activated adhesive. When the hood 60 is placed in an as-worn condition about a wearer's head, the slits 64 cooperate with the hood interior layer 66 to allow a better fit for hood 60. As shown in FIG. 5, the slits 64 expand as the hood 60 extends around a wearer's head, and the hood interior layer 66 stretches to allow more flexibility in hood 60.

Figure 6:
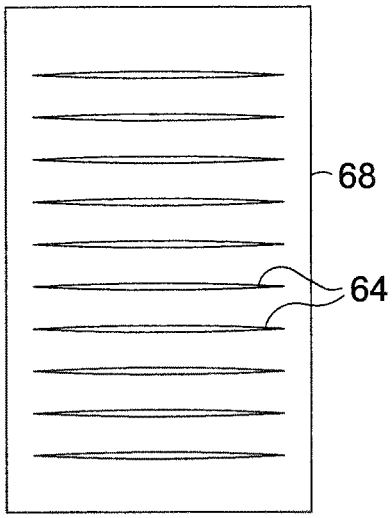
FIG. 6 illustrates a top plan view of an exemplary pattern piece for forming the exemplary hood portion of FIG. 5, in accordance with an aspect herein.
Figure 7:
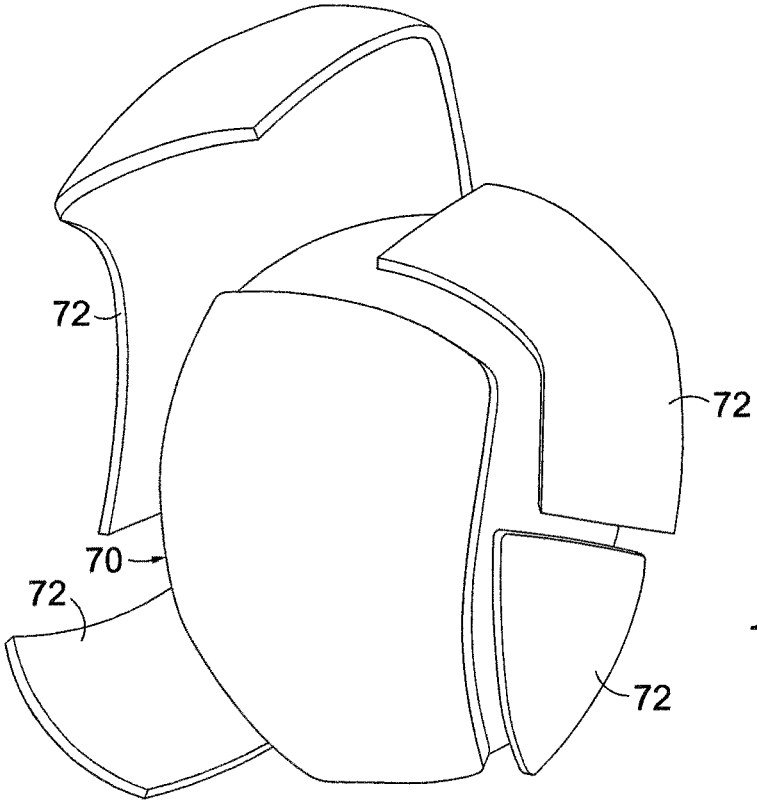
FIG. 7 illustrates a perspective view of an exemplary last used to form the exemplary hood portion of FIG. 5, in accordance with an aspect herein.
Figure 8:
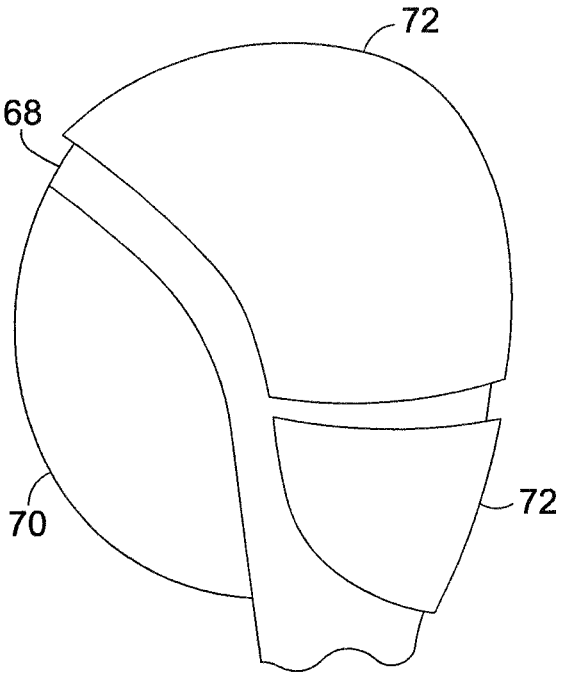
FIG. 8 illustrates the exemplary pattern piece of FIG. 6 in place on the exemplary last of FIG. 7, in accordance with an aspect herein.

In one exemplary aspect, hood 60 is formed from a hood blank 68, shown schematically in FIG. 6. The shape of hood blank 68 will vary based on the desired hood shape in finished form. For simplicity, hood blank 68 is shown in rectangular form in FIG. 6. Hood blank 68 forms the hood body 62, and may be coated with a heat-activated adhesive on one side (the side that will be the internal surface when the hood is worn). Slits 64 may then be cut into hood blank 68. Again, in one exemplary aspect, the slits 64 are made in hood blank 68 using a laser cutter or other type of cutter. The hood interior layer 66 is affixed to the inner surface of hood blank 68. In one exemplary aspect, the hood interior layer 66 is affixed to the inner surface of hood blank 68 by activating the heat-activated adhesive. In one exemplary aspect, hood blank 68 and hood interior layer 66 are placed in a hood last 70 (shown in FIG. 7) that has the desired overall shape for the hood 60. Complimentary mold pieces 72 are placed about the hood last 70, over the hood interior layer 66 and hood blank 68, as shown in FIG. 8. The hood last 70 and/or mold pieces 72 are heated to activate the heat-activated adhesive and affix the hood interior layer 66 to the hood blank 68, forming hood 60 shown in FIG. 5. Other techniques and devices could also be used in affixing hood interior layer 66 to hood body 62.

Figure 9:
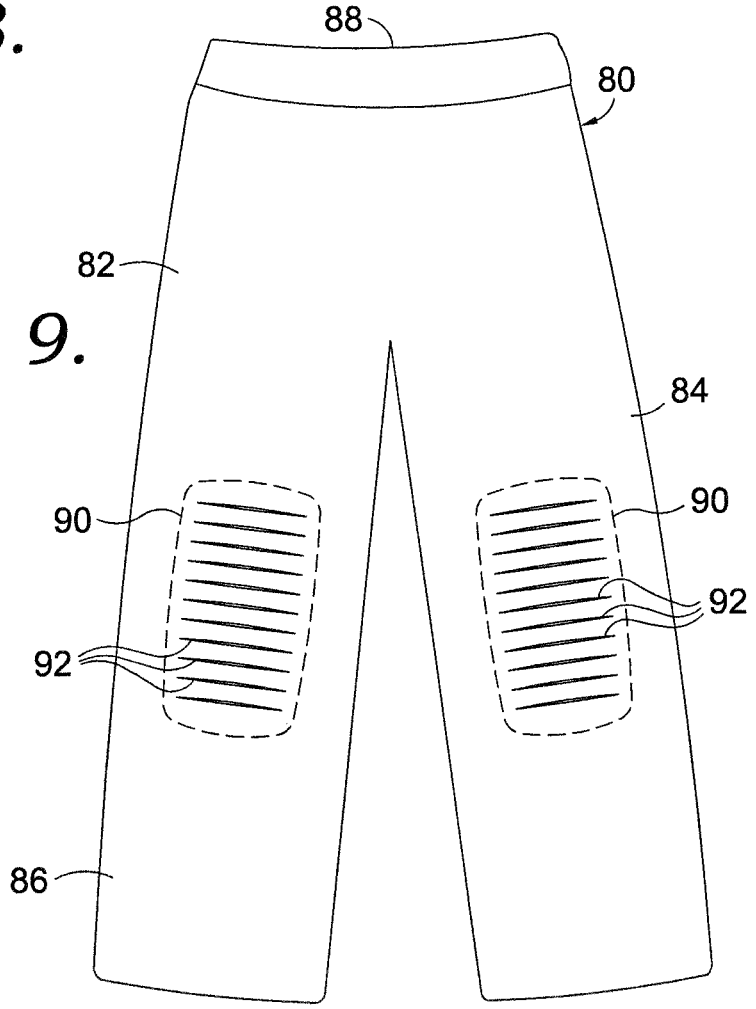
FIG. 9 illustrates a front plan view of an exemplary garment with stretch zones at the knees, in accordance with an aspect herein.

FIG. 9 depicts an alternative garment in the form of a pant 80. Like garment 10 described above, pant 80 has a garment body 82 made from a material having low-stretch characteristics. As an example, and without limitation, garment body 82 can be made from a woven material having low-stretch properties. Pant 80 has a left leg 84, a right leg 86, and a waist area 88. Each leg 84 and 86 may have a stretch zone 90 in the front knee area of the pant 80. Similarly to stretch zones 34, 44, and 48, stretch zones 90 have a series of slits 92 formed therein, and the internal surface of each leg 84, 86 in the area of stretch zone 90 has an interior layer affixed thereto in a similar fashion as that described above with respect to interior layer 42 shown in FIGS. 3 and 4. As seen in FIG. 9, stretch zone 90 may have a somewhat rectangular shape, and slits 92 may be of relatively consistent length throughout the stretch zone 90. As shown, slits 92 are oriented orthogonally to an anticipated typical movement of the knee area of pant 80 in the area of stretch zone 90 when the pant 80 is worn and used. Similarly to stretch zones 34, 44, and 48, slits 92 in stretch zone 90 may have varying widths and/or variable spacing may be employed between the slits 92. Stretch zone 90, having slits 92 and an interior layer having greater stretch properties than garment body 82, allows greater flexibility in the knee area of pant 80. It is contemplated herein that stretch zones may be located at any area of a garment, or portion of a garment, that is subject to higher-than-normal tensioning forces.

Figure 10:
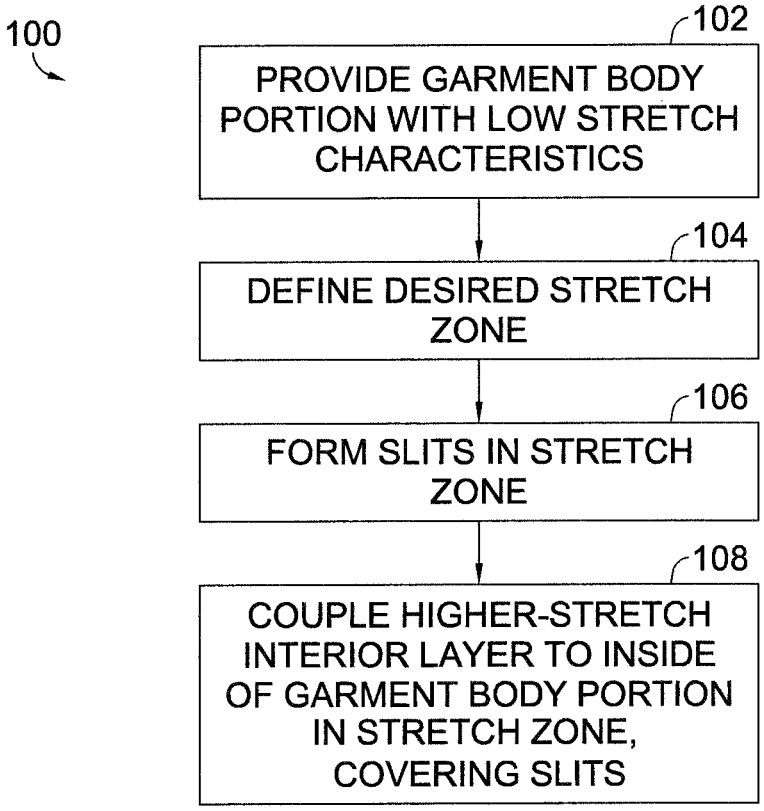
FIG. 10 illustrates a flow diagram of an exemplary method of manufacturing a garment with stretch zones in accordance with an aspect herein.

With respect to FIG. 10, FIG. 10 depicts a flow diagram of an exemplary method 100 of manufacturing a garment, or portion of a garment, having defined stretch zones, such as the garment 10, hood 60, or pant 80 described herein, or portions thereof, in accordance with aspects herein. At a step 102, a garment body portion made from a material having low-stretch characteristics is provided. In an exemplary aspect, this material is a low stretch-woven material. The garment body portion can be of any desired shape, depending on the intended end use, such as the exemplary garment 10, hood 60 or pant 80 described above. At a step 104, one or more stretch zones are defined. Step 104 involves determining where on the garment body, or garment body portion, the one or more stretch zones should be located. In an exemplary aspect, stretch zones may be determined to be located at areas of the garment body that are subject to higher-than-normal tensioning forces.

At a step 106, for each of the defined stretch zones, slits are formed in the garment body portion. In one exemplary aspect, at step 106, the slits are laser cut through the garment body portion in the stretch zones. The slits are oriented to allow expansion of the slits as tensioning forces are applied to the garment in the area of the stretch zones. In an exemplary aspect, the slits are oriented orthogonally to the anticipated tensioning forces on the stretch zone when the garment is in an as worn condition. At a step 108, for each of the one or more stretch zones, an interior layer is affixed to the internal surface of the garment body portion in the area of the stretch zone, such that the interior layer covers the slits in the stretch zone. The interior layer is made from a material having higher stretch properties than the garment body portion. In an exemplary aspect, the internal surface of the garment body portion is coated with a heat-activated adhesive in the area of the stretch zone. With the interior layer in place against the surface of the stretch zone (after the slits are cut), heat is applied to thereby affix the interior layer to the garment body portion. The slits combined with the stretch interior layer provide added flexibility to the garment in the defined stretch zones.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

The invention claimed is:

1. A garment portion having stretch zones, the garment portion comprising:

a garment body portion comprising a material having a first set of stretch characteristics, the material having an external surface and an internal surface; and at least one defined stretch zone on the garment body portion, the at least one defined stretch zone having an area that is less than an area of the garment body portion, the area of the at least one defined stretch zone having outer edges and a middle, the at least one defined stretch zone comprising:

an exterior facing layer defined by the external surface of the garment body portion;

an interior layer affixed to the internal surface of the garment body portion, the interior layer having an area co-extensive with the at least one defined stretch zone and corresponding only to the area of the at least one defined stretch zone, the interior layer having higher stretch properties than the first set of stretch characteristics of the material of the garment body portion; and a plurality of spaced apart slits extending through the at least one defined stretch zone of the garment body portion, wherein the slits have a longer length in the middle of the area of the stretch zone and taper to a shorter length near the outer edges of the area of the stretch zone.

2. The garment portion of claim 1, wherein the slits are of varying length across the area of the stretch zone.

3. The garment portion of claim 1, wherein the interior layer is affixed to the internal surface of the garment body portion with a heat-activated adhesive applied to at least one of the internal surface of the garment body portion in the stretch zone area or to the interior layer.

4. The garment portion of claim 1, wherein the interior layer is one of a stretch-woven or stretch-knit material.

5. The garment portion of claim 1, wherein the stretch zone is located in an area of the garment portion subjected to tensioning forces when the garment portion is worn and used, and wherein the slits are oriented orthogonally relative to the tensioning forces.

6. The garment portion of claim 1, wherein the spacing between the slits of the plurality of slits varies within the stretch zone.

7. The garment portion of claim 1, wherein the interior layer is a contrasting color to that of the material of the garment body portion.

8. An upper body garment comprising:

a right sleeve having an external surface, an internal surface, and a right elbow region; and a left sleeve having an external surface, an internal surface, and a left elbow region, the right sleeve and the left sleeve comprising a material having a first set of stretch characteristics;

wherein the right elbow region includes a right stretch zone and the left elbow region includes a left stretch zone, the stretch zones having an area defining outer edges and a middle, each stretch zone comprising:

an exterior facing layer defined by the external surface of the corresponding right sleeve and left sleeve;

an interior layer affixed to the internal surface of the corresponding right sleeve and left sleeve, the interior layer having an area corresponding to the area of the respective stretch zone the interior layer having higher stretch properties than the first set of stretch characteristics; and a plurality of spaced apart elbow slits extending through the stretch zone, wherein a length of the plurality of spaced apart elbow slits varies across the stretch zone such that the length of the plurality of spaced apart elbow slits is longer in the middle of the stretch zone than near the outer edges of the stretch zone.

9. The upper body garment of claim 8, wherein the interior layer of the stretch zone is affixed to an interior surface of the corresponding right sleeve and left sleeve with a heat activated adhesive applied to at least one of the internal surface of the corresponding right sleeve and left sleeve in the stretch zone area or to the interior layer.

10. The upper body garment of claim 9, wherein the interior layer is one of a stretch-woven or a stretch-knit material.

11. The upper body garment of claim 7, wherein the spacing between the slits of the plurality of elbow slits varies within the stretch zone.

12. The upper body garment of claim 11, wherein the interior layer is a contrasting color to that of the exterior layer.

13. A method of manufacturing a garment portion having stretch zones, the method comprising:

defining at least one stretch zone area on a garment body portion comprising a material having a first set of stretch characteristics, an external surface and an internal surface, the at least one stretch zone area defining outer edges and a middle and having an area that is less than an area of the garment body portion;

creating a plurality of spaced apart slits that are of varying length and that are longer in the middle of the at least one stretch zone and taper to be shorter near the outer edges of the at least one stretch zone, the slits extending through the material of the garment body portion within the at least one stretch zone area; and affixing an interior layer having an area co-extensive with the stretch zone and corresponding only to the at least one stretch zone area to an internal surface of the garment body portion in the at least one stretch zone area.

14. The method of manufacturing of claim 13, further comprising coupling a heat-activated adhesive layer on an internal surface of the garment body portion in the at least one stretch zone area, wherein the affixing comprises activating the heat-activated adhesive.

15. The method of manufacturing of claim 14, wherein the step of creating a plurality of spaced apart slits further comprises creating a plurality of spaced apart slits having varying widths.

16. The method of manufacturing of claim 15, wherein the step of creating a plurality of spaced apart slits further comprises creating the plurality of spaced apart slits in an orthogonal orientation relative to an area of tensioning force when the garment portion is in an as-worn configuration.

* * * * *